United States Patent [19]

Bradbury et al.

[11] Patent Number: 4,731,124

[45] **Date of Patent: * Mar. 15, 1988**

[54] APPLICATION TECHNIQUE FOR THE DESCALING OF SURFACES

[75] Inventors: David Bradbury, Gloucestershire; Timothy Swan, Bristol; Michael G. Segal, Clifton, all of England

[73] Assignee: Central Electricity Generating Board, London, England

[ * ] Notice: The portion of the term of this patent subsequent to Sep. 11, 2001 has been disclaimed.

[21] Appl. No.: 646,307

[22] Filed: Aug. 31, 1984

Related U.S. Application Data

[63] Continuation-in-part of Ser. No. 287,610, Jul. 28, 1981, Pat. No. 4,470,951.

[30] Foreign Application Priority Data

Aug. 11, 1980 [GB] United Kingdom ..... 8026102

[51] Int. Cl.[4] ..... G21C 19/28; C23G 1/00; C23G 1/02; G21F 9/00

[52] U.S. Cl. ..... 134/3; 134/13; 134/26; 134/28; 134/41; 165/95; 252/80; 252/146; 252/148; 252/178; 252/626; 376/305; 376/306; 376/310; 376/313

[58] Field of Search ..... 376/310, 313, 305, 306, 376/309; 165/95; 134/3, 13, 26, 41, 10, 2, 28; 252/147, 148, 181, 81, 87, 626, 105, 80, 178

[56] References Cited

U.S. PATENT DOCUMENTS

| | | | |
|---|---|---|---|
| 2,450,861 | 10/1948 | Robinson | 252/148 |
| 3,054,746 | 9/1962 | Gaden, Jr. et al. | 252/631 |
| 3,297,580 | 1/1967 | Pitzer | 252/626 |
| 3,440,170 | 4/1969 | Hek | 134/3 |
| 3,664,870 | 5/1972 | Oberhofer et al. | 134/3 |
| 3,773,465 | 11/1973 | Keeney et al. | 134/41 |
| 3,873,362 | 3/1975 | Mihram et al. | 134/13 |
| 4,116,863 | 9/1978 | Berton et al. | 252/631 |
| 4,162,229 | 7/1979 | Loewenchuss | 134/3 |
| 4,526,626 | 7/1985 | Carter | 376/306 |

FOREIGN PATENT DOCUMENTS

| | | | |
|---|---|---|---|
| 43-4163 | 2/1968 | Japan | 134/3 |

*Primary Examiner*—Stephen J. Lechert, Jr.
*Assistant Examiner*—Howard J. Locker
*Attorney, Agent, or Firm*—Beveridge, DeGrandi & Weilacher

[57] ABSTRACT

A method of applying a descaling reagent comprising a one-electron reducing agent which is a low oxidation state transition metal ion in combination with a complexing agent to a surface to be treated to descale the surface which method comprises:

(i) maintaining a low oxidation state transition metal ion either in solution under an inert atmosphere in a container made of or lined with an inert material or as a solid salt under an inert atmosphere;

(ii) preparing a solution of the complexing agent and removing oxygen therefrom; and (iii) mixing the ingredients from steps (i) and (ii) either in situ in contact with the surface to be treated, or mixing the ingredients from steps (i) and (ii) prior to application to the surface to be treated under conditions whereby no substantial decomposition of the so-formed reagent occurs.

14 Claims, No Drawings

APPLICATION TECHNIQUE FOR THE DESCALING OF SURFACES

This application is a continuation-in-part application of Ser. No. 287610 filed July 28, 1981, now U.S. Pat. No. 4,470,951.

The present invention relates to an application technique for the descaling of surfaces. In particular the invention relates to an application technique for the dissolution of oxide deposits from systems and equipment, which in consequence of the media with which they are in contact develop the deposits, for example non-radioactive systems and equipment including boilers, pipework and other plant items of chemical process plants, steam boilers and pipes, reactors, heat exchangers, distillation columns, etc., and the cooling system, or components associated with the cooling system, of water-cooled nuclear reactors, or other contaminated plant items, using the particular chemical process which is described in our European Patent Application No. 81300010.6 (Publication No. 0032416).

BACKGROUND OF THE INVENTION

In the chemical and energy industries pipework is used to both transport and exchange heat to and from fluids. In many enviroments this pipe work becomes 'fouled' both by the products of its own corrosion and also by material resulting from corrosion elsewhere which is carried into the system by the fluid flow. The deposits can obstruct both the flow and heat transfer processes requiring that the plant be periodically descaled to return it to its desired performance. A particular example is the accumulation of metal oxide deposits in steamraising plant; these restrict flow in the boiler tubes resulting in increased pressure-drops and in heat transfer impairment and also provide sites for the accumulation of aggressive salts which accelerate tube corrosion.

The construction materials of water-cooled nuclear reactors are corroded by the aqueous coolant and small amounts of their constituent elements are released into the coolant. These constituent elements become neutron activated in the reactor core and are ultimately deposited in the form of their oxides on the vessel and pipework surfaces throughout the coolant circuits, giving rise to large radiation dose rates in the circuit. It is desirable to remove these oxide deposits to reduce the radiation dose rates prior to man access.

Our European Patent Application No. 81.300010.6 describes and claims a process for the removal of deposits consisting essentially of the oxides of one or more transition metals from a surface which process comprises contacting the said surface at a pH below 7.0 with a reagent comprising a one-electron reducing agent which is a low oxidation state transition metal ion in combination with a complexing agent which is thermally stable at the operating pH.

In a preferred aspect of that process the water/steam side of a boiler or a process heat exchanger or the surfaces of a fluid transfer pipe associated with chemical or steam raising plant are desclaed. Thus the transition metal oxide deposits are dissolved and the resulting solution is easily flushed from a complex pipework system, the thermal-hydraulic properties of the system being thereby restored.

In another preferred aspect of that process the cooling system or a component associated with the cooling system of a nuclear reactor, or other contaminated plant items, are decontaminated.

Thus, the radioactive oxides dissolve and a solution is obtained which is suitable for treament by ion exchange to remove both the radioactive ions and the decontaminating chemicals from the system being cleaned. In this preferred process the decontaminating reagents are circulated in the cooling system of the reactor, or contacted with the component to be cleaned in a suitable decontamination facility.

Traditional methods of reactor decontamination employ mixtures of chelating acids which are stable both individually and when mixed in aqueous solution. These acids can therefore be premixed as a solution or slurry and pumped into the circuit to be cleaned. The chemicals to which the present technique relates are, both individually and when mixed, sensitive to both air and the presence of metal surfaces and require special handling techniques if the decontamination process is to be successfully accomplished.

An example of the type of reagent that has previously been used in the decontamination of nuclear reactors is a mixture of citric and oxalic acids. Those chemicals are solids which are stable in air both separately and when mixed together. The mixture can therefore be stored for long periods of time, often years, with no ill effect and it can be dissolved in water in any suitable vessel at any time prior to injection into the reactor or decontamination facility. Stainless steel is the material most commonly used for the preparation and storage of these reagent solutions.

The decontamination reagents described in our European Patent Application No. 81.300010.6 consist of two essential components: a transistion metal ion in a low oxidation state, such as chromium (II) or vanadium (II), and a complexing agent, such as picolinic acid or bipyridyl. The complex formed when the two components are brought together performs the necessary reduction to bring about dissolution of the radioactive oxides. We call these reagents "LOMI" reagents (low oxidation state metal ion reagents).

Although the complexing agent in these reagents is usually a stable chemical, capable of prolonged storage, this does not apply either to the low oxidation state metal ion, in solution or as a solid salt with the appropriate counterion, or the complex formed between the metal ion and the complexing agent. It will be appreciated by those skilled in the art that these reagents are sensitive to oxygen, and must therefore be used under an inert atmosphere. However, we have found that even when oxygen is excluded from these reagents, decomposition of the reducing agent is quite rapid in the presence of materials capable of catalysing the reduction of water by the metal ion. For example, we have found that concentrated solutions of vanadium (II) formate lose much of their reducing ability after only one day in contact with stainless steel. Similarly, dilute solutions of the complex formed between vanadium (II) and picolinic acid rapidly lose their capacity to dissolve oxides when heated in the presence of stainless steel. Other "LOMI" reagents decompose on storage even in vessels made of inert materials such as glass; for example, solutions of vanadium (II), or chromium (II), with the complexing agents ethylenediamine-tetra-acetic acid, or nitrilotriacetic acid, are only stable for a few hours when heated.

SUMMARY OF THE INVENTION

Accordingly, the present invention provides a method of applying a descaling reagent comprising a one-electron reducing agent which is a low oxidation state transition metal ion in combination with a complexing agent to a surface to be treated which method comprises:

(i) maintaining a low oxidation state transition metal ion either in solution under an inert atmosphere in a container made of or lined with an inert material or as a solid salt under an inert atmosphere;

(ii) preparing a solution of the complexing agent and removing oxygen therefrom; and (iii) mixing the ingredients from steps (i) and (ii) either in situ in contact with the surface to be treated or mixing the ingredients from steps (i) and (ii) prior to application to the surface to be treated under conditions whereby no substantial decomposition of the so-formed reagent occurs.

DETAILED DESCRIPTION OF THE INVENTION

In a preferred aspect the present invention provides a method of applying a descaling reagent comprising a one-electron reducing agent based on $V^{II}$ or $Cr^{II}$ in combination with a complexing agent to the surface to be treated, which method comprises:

(i) maintaining the $V^{II}$ or $Cr^{II}$ ion either in solution under an inert atmosphere in a container made of or lined with an inert material or as a solid salt . under an inert atmosphere;

(ii) preparing a solution of the complexing agent and removing oxygen therefrom; and (iii) mixing the ingredients from steps (i) and (ii) either in situ in contact with the surface to be treated under conditions whereby no substantial decomposition of the so-formed descaling reagent occurs.

The complexing agent which is used in the present invention must, in use of the reagent, maintain all metal ions present in solution at the operating pH. It is beneficial if the complexing agent promotes spin pairing when used with $Cr^{II}$ so that the $Cr^{II}$ ion will undergo rapid outer sphere transfer reactions, and should not lower the redox potential of the system to a value such that the rate of water reduction can compete with the dissolution process. Examples of suitable complexing agents are ethylene diamine tetraacetic acid, citric acid, picolinic acid, 2,2'-bipyridyl, histidine, nitrilotriacetic acid under 2,6-dicarboxy pyridine.

Specific examples of the reagents for use in the invention are a one-electron reducing agent based on $V^{II}$ in combination with picolinic acid and a one-electron reducing agent based on $Cr^{II}$ in combination with bipyridyl.

The concentration of metal ion used in the reagents is preferably $10^{-3}$ to 2M, more preferably $10^{-3}$ to $10^{-2}$M. The molar concentration of the complexing agent is generally from 3 to 10 times the molar concentration of the one-electron reducing agent. When formate or acetate is present as the counterion in the reagents they are generally employed at a molar concentration of from 5 to 20 times the molar concentration of the one-electron reducing agent.

In carrying out the method of the invention the one-electron reducing agent is stored and transported either in solution under an inert atmosphere and in a container made of or lined with an inert material, such as glass or plastic, or as a solid salt under an inert atmosphere. This component is combined with the complexing agent in such a manner that the final reagent thus formed is not destroyed before performing the decontamination, by reaction with oxygen, or by the catalytic effect of metal surfaces in promoting spontaneous reaction with water. A solution of the complexing agent, and any other reagent required for the control of pH, or a surfactant, is prepared and oxygen is removed therefrom for example by sparging with an inert gas such as nitrogen. Hydrazine may be added to the solution to ensure complete removal of oxygen. This solution is then brought to the desired temperature, for example 80° C. The one-electron reducing agent is then added to the solution so prepared, using an atmosphere of inert gas, in one of three ways. The solution described above may be contacted with the surface to be treated prior to the introduction of one-electron reducing agent in solution. The final reagent is thus formed directly in situ. The solution described above may be contacted with the surface to be treated while the one-electron reducing agent, in solution also, is simultaneously contacted with the surface to be treated so that the final reagent is formed in situ. Alternatively, the solution described above may be prepared in a vessel made of or lined with, an inert material such as glass or plastic, and the one-electron reducing agent may then be added either in solution as a solid salt, and mixed with the complexing agent to form the required reagent prior to contact with the surface to be treated under conditions whereby no substantial decomposition of the reagent occurs, for example by mixing the reagents in a vessel made of or lined with an inert material.

When the reagent to be used is a complex such as vanadium (II) with picolinate, any of these three methods could be applied. When the reagent is liable to undergo spontaneous reaction with water, for example the chromium (II) nitrilotriacetate complex, then the third method described above would be least satisfactory. The first method will result in the most efficient use of the reagent with any of the reagents described.

The concentration of the "LOMI" reagent may be followed by measuring the visible or ultra-violet spectrum of the solution during the course of the descaling, either by periodic removal of samples for analysis under air-free conditions, or by the continuous bleeding of solutions through a suitable colorimeter or spectrophotometer.

Further addition of the reduced metal ion may be made during the course of the descaling process, if required. This may be necessary if the amount of oxide to be removed is greater than anticipated, or if reagent and dissolved activity are being continuously removed by ion exchange, or if significant decomposition of the "LOMI" reagent occurs. Addition of further complexing agent may also be required. The methods for such additions are the same as in the intial injection of reagents.

Under conditions where the reagent experiences a strong field of radiation, e.g. in the core of a pressurised water reactor, some "LOMI" reagents are regenerated by reactions involving formic acid, as described in our European Patent Application No. 81,300010,6. There may therefore be the need to add further formic acid. This is injected via the same system as used for the reduced metal ion solution, either as formic acid directly or as a solution of an appropriate salt, such as lithium formate or ammonium formate.

After the reagent has been circulated through the system being cleaned it is removed from the system. The simplest method of removal is to drain the reagent from the system replacing it by clean water and to rinse the system several times. However, if the surface treated is radioactive then this may lead to unacceptable quantities of radio-active waste solution and in this case the preferred method of treatment is therefore to pass the solution through cation and anion exchange resins which remove both the radio-active ions and the decontaminating reagent and provide all the waste in a convenient solid form.

EXAMPLE 1

A reagent based upon vanadium (II) (as the low oxidation state metal ion) and picolinic acid (as the complexing agent) was used to decontaminate the south circuit of the Steam Generating Heavy Water Reactor (SGHWR) at Winfrith Heath, Dorset, U.K.

For this exercise, vanadium (II) formate was produced in the form of a solution having the approximate composition vanadium (II) ion 0.2M formate/formic acid 2M in water. The solution was produced by the direct electrolysis of $V_2O_5$ in formic acid as described in our European Patent Application No. 81.30010.6. The solution was transferred to and stored in commercially available high density polythylene drums each having a capacity of 220 liters. The drums were thoroughly purged with an inert gas before filling. A total volume of 1,700 liters was produced. The vanadium (II) formate solution was transported to the reactor site and stored prior to use. The period of storage was up to two weeks.

Picolinic acid was obtained as the pure solid (400 kg) and was transported to the reactor site without special measures.

At the reactor site the picolinic acid was dissolved in 30,000 liters of water in a stainless steel reagent tank.

The solution was heated to 80° C. by steam and the solution was freed of oxygen by the passage of oxygen-free nitrogen from sparge-pipes through the solution. In order to ensure that the reagent formed in the reactor was at the correct pH value for the decontamination, it was necessary to add sodium hydroxide solid (125 kg) to the tank liquor. Mixing of the reagents was ensured by nitrogen and steam sparging and also by pumping the reagent around a closed loop.

The reactor was made ready for decontamination by filling the circuit to the maximum level and injecting hydrazine with the reactor coolant pumps running until a stable value of hydrazine concentration was obtained (the hydrazine removes residual oxygen in the reactor circuit). The reactor pumps were then stopped and the coolant was partially drained to make space for the decontaminant solution. The reactor water was displaced with oxygen-free nitrogen.

Injection of the decontaminant solution then took place. The vanadium (II) formate solution was pumped from the storage drums (the solution in the drums being displaced by oxygen-free nitrogen) and the picolinic acid/sodium hydroxide solution from the make up tank, and the two streams mixed as they entered the reactor pipework leading to the steam drum. The rate of injection of each of these chemicals was monitored to ensure that injection took place evenly, and that the vanadium (II) formate addition was complete before the picolinic acid/sodium hydroxide addition in order to allow for flushing of the injection pipework with the latter solution.

Once injection was complete the reagent tank was isolated by closing the appropriate valves, and circulation of the decontamination reagent was effected by operation of the reactor coolant pumps.

When decontamination was complete the circuit was partially drained and refilled repeatedly until the coolant water had the appropriate chemical constitution.

The efficiency of these arrangements for the production of the decontaminating solution in the reactor was confirmed by spectrophotometric determination of the vanadium (II) picolinate complex in samples of reactor coolant water taken immediately after injection of the reagent and prior to circulation. About 23 kg of metal oxide deposits were dissolved by the reagent during the decontamination which is equivalent to that expected for the amount of reagent added.

EXAMPLE 2

The descaling of non-radioactive boiler tubes using the methods described in this application was carried out on a laboratory scale. Samples of 9% Chromium ferrite boiler tube where a layer of oxide had grown in a steam/water environment at 350° C. under alkaline oxygenated conditions, were inserted into a glass recirculation system wherein process fluid was drawn from and returned to a 5 $dm^3$ glass reservoir.

The latter was fitted with facilities for adding both solid and liquid chemicals. Process water containing $10^{-2}$M picolinic acid and sodium hydroxide was deoxygenated by heating and sparging with argon or nitrogen. Final traces of oxygen were removed by the addition of hydrazine. This solution was circulated through the tube specimens which it was desired to descale and heated to 80° C. Vanadous formate solution was then added to the reservoir to form vanadous picolinate LOMI reagent in-situ to give a final reagent concentration of $2\times10^{-3}$M and a pH of 5.6. All iron-rich oxide was removed from the tube surface after a period of 20h leaving a chromium rich oxide layer (>20 cation % Cr) on the metal-surface. Dissolution progress was followed by measuring the concentration of dissolved iron and vanadium (II).

EXAMPLE 3

Vanadous picolinate was applied to tubes in a retired evaporator unit constructed from 2.1/Cr 1Mo ferritic alloy. These tubes carried up to 20um thickness of $Fe_3O_4$ at near theoretical crystal density laid down under conditions of high heat flux. The tubes were attached to a recirculation rig constructed from stainless steel. In order to reduce the catalyic destruction of LOMI reagent at steel surfaces, the surfaces of the main reservoir were coated with an epoxy paint to provide an inert organic surface. As in Example 2 the LOMI reagent was formed in-situ. $5\times10^{-2}$M picolinic acid containing 100 ppm of di-butylthiourea corrosion inhibitor was degassed by nitrogen sparging and hydrazine addition to the reservoir. The process solution was circulated and heated to 90° C. when vanadous formate was added to the reservoir to form final concentration of $10^{-2}$M vanadous picolinate at pH 4.4. Two 4h applications were required to remove all oxide leaving the clean base metal.

In both this Example and Example 2 formate was made by the electrolysis of $V_2O_5$ in formic acid and was stored in either glass or polythene lined steel vessels with rigorous exclusion of air. Since the descaling process involved conventional materials, waste was flushed from the system by clean water, there being no requirement to isolate the dissolved metal ions by ion-exchange.

EXAMPLE 4

A small specimen cut from a pipe in the Winfrith Steam Generating Heavy Water Reactor was decontaminated with a reagent consisting of a complex of chromium (II) and a chelating ligand. The specimen had a surface area of approximately 0.5 to 0.5 cm bearing radioactive oxides. It as exposed for six hours to a solution of the comples $Cr(NTA)^-$, at a concentration of $8\times10^{-3}$M, formed by the addition of an excess of nitrilotriacetic acid, in a formate buffer, to a solution of $Cr^{2+}$. 100 ml of solution were used at a temperature of 80° C. At the end of this treatment, examination of the oxide film and measurement of the radioactivity of the specimen showed that at least 90% of the deposited oxide layer had been dissolved.

We claim:

1. Method of applying a descaling reagent comprising a one-electron reducing agent which is a low oxidation state transition metal ion based on $V^{II}$ or $Cr^{II}$ in combination with a complexing agent to a surface to be treated to descale the surface which method comprises:

(i) maintaining the low oxidation state transition metal ion either in solution under an inert atmosphere in a container made of or lined with an inert material or as a solid salt under an inert atmosphere;

(ii) preparing a solution of the complexing agent and removing oxygen therefrom; and (iii) mixing the ingredients from steps (i) and (ii) either in situ in contact with the surface to be treated or mixing the ingredients from steps (i) and (ii) prior to application to the surface to be treated under conditions whereby no substantial decomposition of the so-formed reagent occurs.

2. Method as claimed in claim 1 wherein in step (iii) the solution of the complexing agent is contacted with the surface to be treated prior to the addition of the low oxidation state transition metal ion in solution to form the descaling reagent in situ.

3. Method as claimed in claim 2 wherein in step (iii) the solution of the complexing agent and the $V^{II}$ or $Cr^{II}$ ion in solution are contacted simultaneously with the surface to be treated to form the descaling reagent in situ.

4. Method as claimed in claim 2 wherein in step (iii) the solution of the complexing agent and the $V^{II}$ or $Cr^{II}$ ion in solution are mixed in a vessel made of or lined with an inert material prior to contacting the surface to be treated.

5. Method as claimed in claim 2 wherein in step (i) the one-electron reducing agent is maintained in a container made of or lined with glass or plastic.

6. Method as claimed in claim 2 wherein in step (ii) oxygen is removed from the solution of the complexing agent by sparging with an inert gas or by the addition of hydrazine.

7. Method as claimed in claim 6 wherein the inert gas is nitrogen.

8. Method as claimed in claim 2 wherein the complexing agent is ethylene diamine tetracetic acid, citric acid, picolinic acid, 2,2'-bipyridyl, histidine, nitrilotriacetic acid or 2,6-dicarboxy pyridine.

9. Method as claimed in claim 2 wherein the reagent comprises a one-electron reducing agent based on $V^{II}$ and picolinic acid as the complexing agent.

10. Method as claimed in claim 2 wherein the reagent comprises a one-electron reducing agent based on $Cr^{II}$ and a complexing agent selected from bipyridyl or nitrilotriacetic acid.

11. Method as claimed in claim 2 wherein the concentration of the one-electron reducing agent is in the range of from $10^{-3}$ to 2M.

12. Method as claimed in claim 11 wherein the concentration of the one-electron reducing agent is in the range of from $10^{-3}$ to $10^{-2}$M.

13. Method as claimed in claim 2 wherein the molar concentration of the complexing agent is from 3 to 10 times the molar concentration of the one-electron reducing agent.

14. Method as claimed in claim 2 wherein formate or acetate is present as a counterion at a molar concentration of the one-electron reducing agent.

* * * * *